US008287199B2

(12) United States Patent
Salciarini et al.

(10) Patent No.: US 8,287,199 B2
(45) Date of Patent: Oct. 16, 2012

(54) CONTAINER FOR A PASTY OR LIQUID COSMETIC PRODUCT WITH RETRACTABLE APPLICATION MEMBER

(75) Inventors: Christian Salciarini, Couilly Pont aux Dames (FR); Benoît Donier, Tarcenay (FR)

(73) Assignee: Chanel Parfums Beaute, Neuilly-sur-Seine (FR)

( * ) Notice: Subject to any disclaimer, the term of this patent is extended or adjusted under 35 U.S.C. 154(b) by 9 days.

(21) Appl. No.: 13/124,090

(22) PCT Filed: Oct. 9, 2009

(86) PCT No.: PCT/FR2009/051929

§ 371 (c)(1),
(2), (4) Date: Apr. 13, 2011

(87) PCT Pub. No.: WO2010/043802

PCT Pub. Date: Apr. 22, 2010

(65) Prior Publication Data

US 2011/0200382 A1 Aug. 18, 2011

(30) Foreign Application Priority Data

Oct. 13, 2008 (FR) ..... 08 05652

(51) Int. Cl.
*B43K 24/02* (2006.01)
*A46B 11/00* (2006.01)

(52) U.S. Cl. ..... 401/109; 401/122; 401/126

(58) Field of Classification Search ..... 401/109–114, 401/116, 120, 122, 126, 127, 129, 151
See application file for complete search history.

(56) References Cited

U.S. PATENT DOCUMENTS 5,636,931 A * 6/1997 Gueret ..... 401/126
5,803,638 A * 9/1998 Gueret ..... 401/122
7,841,794 B2 11/2010 Legastelois et al.
(Continued)

FOREIGN PATENT DOCUMENTS

DE 3426351 A1 1/1986
(Continued)

OTHER PUBLICATIONS

International Search Report; International Application No. PCT/FR2009/051931; dated Feb. 10, 2010.
(Continued)

*Primary Examiner* — Tuan N Nguyen
(74) *Attorney, Agent, or Firm* — Hunton & Williams, LLP

(57) ABSTRACT

The invention relates to a vial for a liquid or pasty cosmetic product, comprising an elongate body having a base area (11) and a free edge (12), a vessel (20) containing said product and which is translatably movable in the body between a bottom rest position and a top working position, an elastically compressible guide device with a stable retracted configuration determining the bottom position and a maximum extension configuration determining the top position, comprising a hollow guide track in which a guide pin is inserted at least in the maximum extension configuration, as well as an application element (30) comprising a cap (40) suitable for being inserted inside the body and, in the opposite direction, for being at least partially extracted from said body by the elastically compressible guide device. An elastic insert (67) is provided next to said guide track to slow the movement of the guide pin when the elastically compressible guide device exits the maximum extension configuration thereof due to the cap being pushed into the body.

16 Claims, 17 Drawing Sheets

U.S. PATENT DOCUMENTS

| | | | |
|---|---|---|---|
| 2004/0119297 | A1 | 6/2004 | Bella et al. |
| 2006/0285911 | A1 | 12/2006 | Demellier |

FOREIGN PATENT DOCUMENTS

| | | |
|---|---|---|
| EP | 1721543 | 11/2006 |
| FR | 2865910 | 8/1985 |
| FR | 2870092 | 11/2005 |
| GB | 834486 | 5/1960 |

OTHER PUBLICATIONS

International Search Report; International Application No. PCT/FR2006/001030, dated Sep. 13, 2006, 3 pages.
International Search Report; International Application No. PCT/FR2009/051929; dated Oct. 9, 2009.
European Search Report; Application No. EP1721543A1, dated Aug. 31, 2006.

* cited by examiner

CONTAINER FOR A PASTY OR LIQUID COSMETIC PRODUCT WITH RETRACTABLE APPLICATION MEMBER

CROSS-REFERENCE TO RELATED APPLICATIONS

This application is the U.S. National Phase of International Application No. PCT/FR2009/051929 filed on Oct. 9, 2009, which claims priority to French Application No. FR 08/05652 filed Oct. 13, 2008, both of which are incorporated by reference herein in their entireties.

FIELD OF THE INVENTION

The invention concerns a container for a pasty or liquid cosmetic product, comprising an application member provided with an applicator which, outside periods when the product is applied, is engaged in a tubular reservoir containing the product to apply; it applies particularly, but not exclusively, to mascara containers, and even gloss containers.

BACKGROUND

Such containers, in particular mascara containers, conventionally comprise a wiper provided close to the neck of the container (in practice on the reservoir), which is adapted to keep back the excess product taken by the applicator on being plunged into the reservoir.

In practice the application member comprises a cap which the user acts upon to manipulate the mascara applicator. The fact that the mascara is liquid or pasty means that efficient sealing must be provided outside periods when mascara is applied, when the cap is engaged on the neck of the container; in practice this sealing is obtained by screwing or by clip action of the cap onto the neck of the container. It follows that the cap is a member which forms a substantial part of the outside surface of a mascara container in closed configuration, and that combined movements or significant forces may have to be provided to open the container before an action to apply mascara.

Document EP-1 721 543 describes various containers for cosmetic product including a mascara container (cf. FIGS. 18-24) comprising:

- a body which is elongate in a longitudinal direction and provided with a bottom and a free edge,
- a reservoir contained in that body and movable in translation between a low stable position and a high stable position, the reservoir comprising a neck,
- an elastically compressible device with two stable retraction positions which is disposed between the body and the reservoir and of which the two stable axial retraction positions define the two stable positions, low and high, of the reservoir,
- an application member comprising a shaft terminated by an applicator adapted to be loaded with mascara, this application member having a resting configuration in which a part of the shaft and the applicator are contained in the reservoir so as to enable the applicator to be loaded with mascara, and being able to be completely out of the reservoir and of the container,
- a cap joined to the shaft of the application member and adapted to engage within the body, the stable axial retraction configurations of the elastically compressible device being such that when the application member is in its resting configuration in the reservoir, the cap is either retracted into the body flush with the free edge of the body, or it projects at least partially from the body,
- a wiper provided at the exit of the reservoir so as to be passed through by the applicator when it enters the reservoir or when it is extracted therefrom, and
- complementary sealing members respectively carried by the shaft and the neck of the reservoir.

Such a configuration is simple and reliable in use without significant risk of inadvertent opening, while making it possible to have very sleek aesthetics, and without leading to prohibitive voluminosity.

More particularly, the retraction of the cap into the body of the container enables the aesthetics of the container to be essentially defined by that body, while the presence of the elastically compressible device with two stable retraction positions enables a mere movement of pushing in of the cap, transmitted to the reservoir, to give rise to the passage of that device from one retraction position to the other, and leads either to the retraction of the cap (and there is very little risk of the cap inadvertently getting out of the body), or to a part of that cap coming to project sufficiently to enable that projecting part to be grasped between the fingers of a user then its extraction out from the body to perform the application of the product taken by the applicator (which only requires the user to make movements that are simple, with a single hand).

However, such a container as described in document EP-1 721 543 must comply with various dimensional constraints.

Thus the axial distance over which the cap comes to project in the high stable position relative to the body must be sufficient to enable grasping by a user, whereas that distance is equal to the axial distance between the high and low positions of the elastically compressible device; the travel of that elastically compressible device must therefore be all the greater when it is desired to facilitate that grasping.

Furthermore, in the example described in the aforementioned document, the complementary sealing members are constituted by a protuberance carried by the shaft between the cap and the applicator, and anchoring claws provided on the neck of the reservoir: in low configuration of the reservoir, those claws are radially supported by the inside wall of the body so as to remain engaged on that protuberance, whereas the high position of the reservoir is such that the claws are outside the volume of the body, so as to be able to move apart radially and release the protuberance. It follows therefrom that, when such a form of complementary sealing members is chosen, it must be provided for the cap to be completely out of the body in the high configuration of the reservoir. Consequently, when such a choice is made, the travel of the elastically compressible device must be all the greater when it is desired to choose a large height for the cap.

On a subsidiary basis, with regard to such a choice for the complementary sealing members, it may be noted that the geometry proposed in the aforementioned documents implies very precise dimensioning to provide good sealing.

Also on a subsidiary basis, with regard to such a choice, it may be noted that the existence of the claws, which participate in the definition of the opening which the shaft and its applicator must pass through on entering the reservoir or on extraction therefrom, allows slots to remain which are liable to be clogged by the product carried by the applicator, which may adversely affect the cleanliness of the neck of that reservoir, as well as the durability of the applicator (if there is a risk of the latter being degraded when getting past those claws). Furthermore, in the example proposed in that document in which the protuberance is substantially sphere-shaped, the movement towards each other of the claws leads to applying an axial force on the shaft, which may vary over time or with the wear of those claws, such that the sealing effect is also liable to vary over time.

SUMMARY OF THE INVENTION

The invention seeks to mitigate at least some of the aforementioned drawbacks. It thus relates to a container for a pasty or liquid cosmetic product comprising an application member and a reservoir which is adapted to contain that product and to sealingly receive a part of the application member when it is in a resting configuration, the reservoir being movable under the action of an elastically compressible device having two stable retraction configurations, and the container being simple and reliable in use with a construction which enables the axial dimensions of the various components to be freely chosen, independently of the travel of that elastically compressible device and of the force of the spring thus employed and which enables maintenance of the reservoir in the high position which is sufficient to ensure that the application member can enter and come out from the reservoir (in particular where a mascara container is provided with a wiper) without the latter descending before the user wishes to close the container.

According to another aspect of the invention, the latter relates to a container for a pasty or liquid cosmetic product, comprising an application member and a reservoir which is adapted to contain that product and to receive a part of the application member when it is in a resting configuration, which is simple and reliable in use, employing an elastically compressible device with two stable retraction configurations, while durably providing good sealing between the reservoir and the application device on movements of that reservoir in the body and while minimizing the risks of clogging.

It can be easily understood that these two aspects may be combined or not be combined, such that the second aspect may not only be considered as an advantageous aspect per se, but also as a useful complement of the first one.

In connection with the first aspect, the invention provides a container for a pasty or liquid cosmetic product, comprising:

- an elongate body, extending in a longitudinal direction, provided with a bottom zone and a free edge,
- a reservoir containing that product and which is movable in translation in the body between a low resting position close to the bottom zone and a high working position close to the free edge, that reservoir comprising a neck,
- an elastically compressible guide device, situated between the body and the reservoir, having a stable retracted configuration determining the low resting position of the reservoir and a maximum extension configuration determining the high working position of that reservoir, the passage of the device from one to the other of those configurations being made by retraction beyond the stable retracted position against a spring, the device comprising, on one of the body and the reservoir, a hollow guide track disposed substantially in the longitudinal direction of the body, and, on the other of the body and the reservoir, a follower finger engaged in that hollow guide track, at least when the device is in its maximum extension configuration,
- an application member comprising a shaft joined to a cap and terminating by an applicator adapted to be loaded with product when it is plunged into the reservoir in a configuration for reloading relative to that reservoir in which the shaft passes through the neck of that reservoir, that cap being adapted, in the reloading configuration, to engage inside the body by pushing the reservoir into the body until it reaches its low resting configuration and, in the other direction, adapted to be at least partly extracted from the body under the action of the elastically compressible guide device so as to enable the extraction of the application member out of the reservoir and the body, characterized in that a mounted-on elastic member is provided in the vicinity of that guide track to constitute a resistant braking point on passage of the follower finger when the elastically compressible guide device leaves its maximum extension configuration as a consequence of pushing in of the cap into the body.

It is to be noted that the presence of the elastic member, which tends to prevent the follower finger from leaving its position in which the reservoir is in its high working position, gives the advantage that it is no longer necessary to dimension the spring such that it can provide that holding.

Furthermore, the fact that this elastic member is a mounted-on member enables it to be produced from a material independent from that chosen for the body or the reservoir; it may furthermore be changed during the period of service of the container. The fact that this elastic member is a mounted-on member also has the advantage that it may be chosen, for a given body and reservoir, according to the product contained in the reservoir and according to the resistance provided by a possible wiper to the passage of the applicator, and thus according to the constitution and geometry of that applicator.

Advantageously, the application member and the reservoir comprise complementary members suitable for linking that member to that reservoir during the travel of the latter from its low resting position to its high working position, so as to enable an extraction force applied to the cap of the application member to cause a movement of the reservoir towards its high working position; it follows therefrom that the dimensioning of the spring no longer needs to be sufficient to bring the reservoir into its high working position; it suffices for that spring to be sufficient to push back the reservoir over a sufficient distance for the cap to provide a sufficient grip to enable the continuation of its extraction by the user.

These complementary linking members are advantageously designed to provide, furthermore, sealing between the shaft of the application member and the reservoir.

Advantageously the follower finger remains engaged in the hollow guide track when the elastically compressible guide device passes from one of its configurations to the other, that hollow guide track comprising a heart-shaped portion with a W-shaped zone of which the central portion determines said stable retracted configuration and which can only be passed along by the follower finger in a single direction; it follows therefrom that the hollow guide track and the follower finger serve not only for guiding, but also in defining the stable retracted configuration. As a variant, this definition is provided by members that are different from that guide track and from the follower finger, for example by members similar to those described in the document EP-1 721 453 with regard to its FIGS. 11 to 13.

That heart-shaped portion comprises, at the axially opposite end to the W-shaped zone, a pointed zone in which the follower finger may, in one embodiment, be situated when the elastically compressible guide device is in its maximum extension position; however, preferably, this heart-shaped zone is spaced away from the zone of that hollow guide track in which the follower finger is engaged when the device is in its maximum extension configuration; this enables the hollow guide track to be dimensioned while dissociating the constraints linked to the definition of the high position conjointly with the elastic member and the constraints linked to the constraints concerning the definition of the low retracted configuration; furthermore, the heart-shaped portion may itself be dimensioned independently of the travel desired for the reservoir between its high and low positions.

According to an advantageous embodiment, the part of the track defining the high working position of the reservoir, conjointly with the elastic member and the follower finger, is a drop-shaped portion the point of which is oriented towards the point of the heart shape; preferably the drop-shaped portion comprises, at its junction with the rest of the guide track, a flank forcing the finger to follow a branch of the drop shape which is different from the branch wherein the elastic member constitutes a breaking means, Since the drop-shaped portion is designed so as to be able to be passed along by the follower finger in only one direction, this makes it possible for the elastic member to be able to brake the passage of the follower finger only in one direction, corresponding to the case in which the reservoir leaves its high position towards in the direction of its low position.

The hollow guide track may, between the heart-shaped and drop-shaped portions, comprise a single longitudinal portion adapted to be passed along by the follower finger in both directions, or on the contrary comprise two parallel longitudinal branches each adapted to be passed along in a single direction (these portions not in that case having pointed zones). However, it is simpler and more compact to provide a single two-way portion of track.

Advantageously, the mounted-on elastic member is a mounted-on elastic strip, preferably of metal, which is disposed close to a lateral flank of that track such that said passage of the finger causes deformation of that blade. It may be understood that, if the zone of the guide track in which the follower finger is engaged in the high configuration of the reservoir is a single two-way portion, such an elastic member provides braking of the passage of the finger, not only when the reservoir leaves its high position, but also when it arrives there.

The follower finger is advantageously carried by the and of a generally longitudinal arm, enabling the finger to follow the curves of the hollow guide track; this arm may be articulated or be flexible; it is advantageously disposed so as to be acted on in compression when the elastically compressible device is in its retracted stable configuration.

When, in its zone receiving the follower finger, the guide track is a portion able to be passed along in both axial directions, the mounted-on elastic member may also be a U-shaped part of which the branches are longitudinally oriented while being configured so as to form a space between them able to receive the follower finger, while defining, at the opposite end to the bottom of the U relative to that space, a constriction that can only be passed by the finger, from that space towards the outside of the U, by spreading apart of those branches caused by that finger.

Advantageously, that U-shaped part is engaged in a cavity which is provided set back relative to the bottom of the track and provided with a connecting ramp for connecting to the rest of that bottom, such that the follower finger can slide over the branches until it latches into the space formed in the U-shaped part, when the reservoir approaches its high working position, whereas, when the reservoir is urged towards its low resting position, the finger must pass that constriction by spreading apart the branches so as to be able, by virtue of the ramp, to attain the bottom of the track.

It can thus be understood that the mounted-on elastic member, which is formed by a strip mounted on one side of the guide track or formed by a U-shaped part, is advantageously an elastic member capable of deforming parallel to the walls of the reservoir and of the body, transversely to the longitudinal direction of the body.

In such case, the follower finger is advantageously carried by an elastic strip pressing the finger towards the bottom of the hollow guide track.

As a variant, the mounted-on elastic member constituting a resistant point carries the follower finger. In this way, as indicated above, the follower finger may be carried by an elastic strip pressing the follower finger towards the bottom of the hollow guide track; in such a case, the U-shaped part engaged in a cavity provided set back relative to the bottom of the hollow guide track may be replaced by a mounted-on part comprising a hollow adapted to receive, by latching, the follower finger in the high position of the reservoir, whereas the follower finger may comprise a ramp-forming flank to enable it to leave that hollow in case substantial force is provided to force the reservoir to leave its high position; in another embodiment, that follower finger is connected to a support, for example a generally longitudinal arm by a flexible connection zone, by virtue of which that follower finger may incline longitudinally so as to escape from the hollow of the part.

It may be noted that, when the heart-shaped portion determining the retracted stable configuration of the elastically compressible device is only part of the hollow guide track, its corner-shaped zone no longer constitutes a passage zone for the finger (in fact that zone constitutes a routing device to guide the finger to one only of the two portions of the heart shape when the finger returns to that heart-shaped portion), independently of the zone receiving the follower finger when the reservoir is in its high position. It follows that the role of the point of the heart-shaped portion of the guide track of a container according to such an embodiment of the invention, is different from that of the heart-shaped track which is described in document EP-1 721 453.

According to advantageous features of the invention, which may be combined:

- the hollow guide track is joined to the body and the follower finger is joined to the reservoir,
- the body comprises a tube and a mounted-on cage, the hollow guide track being formed in that mounted-on cage, that mounted-on cage having the form of a sleeve having a longitudinal slot adapted to enable the lateral entry of the reservoir into the internal volume of that sleeve, before putting that mounted-on part in place in the tube.
- it comprises C-shaped transverse parts engaged in a transverse slot of the mounted-on part and by which that mounted-on part is anchored into the inner wall of the tube,
- the spring, the hollow guide track and the follower finger are disposed between the lateral walls of the body and of the reservoir,
- the shaft comprises a protuberance comprising, towards the applicator, a sealing portion and, towards the cap, a transverse contact surface, and the reservoir comprises, before reaching its neck, a seat-forming constriction adapted to receive the sealing portion in axial abutment and, beyond its neck, a collar formed, along its circumference, by a plurality of rigid sectors and elastic sectors, that collar having a relaxed configuration in which it is of larger size than the inside cross-section of the body and a restricted configuration in which it is confined inside that body, the rigid sectors comprising, along the inside edge of that collar, rims adapted to come into axial abutment against the transverse contact surface of the protuberance so as to maintain the sealing portion against the constriction when the application member is in its resting configuration, at least the rigid sectors of the collar further comprise outside rims bearing against the inside wall of the body for maintaining the collar in its restricted configuration inside the body, the collar is linked by a skirt also formed by rigid or flexible portions, capping the constriction of the reservoir, the constriction forms part of a mounted-on part of the reservoir which, towards the inside of the reservoir, comprises a wiper lip according to a variant, the sealing means comprise a protuberance of the aforementioned type, formed on the shaft of the application member, and bosses, or "rice grains" provided within a cavity of the reservoir, adapted to be passed by the protuberance when that application member is engaged in the reloading configuration in the reservoir, and to maintain that protuberance against its seat, so long as that application member remains in that reloading configuration; thus these bosses contribute to effective linking of the reservoir and of the application member so long as the reservoir has not reached its high working position, the sealing portion of the protuberance comprises a seal which is for example a mounted-on seal.

It can be understood that the aforementioned cooperation between the protuberance of the shaft and sealing members provided in the vicinity of the neck of the reservoir satisfy the second aspect of the invention.

BRIEF DESCRIPTION OF THE FIGURES

Objects, features and advantages of the invention will appear from the following description, given by way of illustrative non-limiting example with reference to the accompanying drawings in which.

DETAILED DESCRIPTION OF PREFERRED EMBODIMENTS

Figure 1:
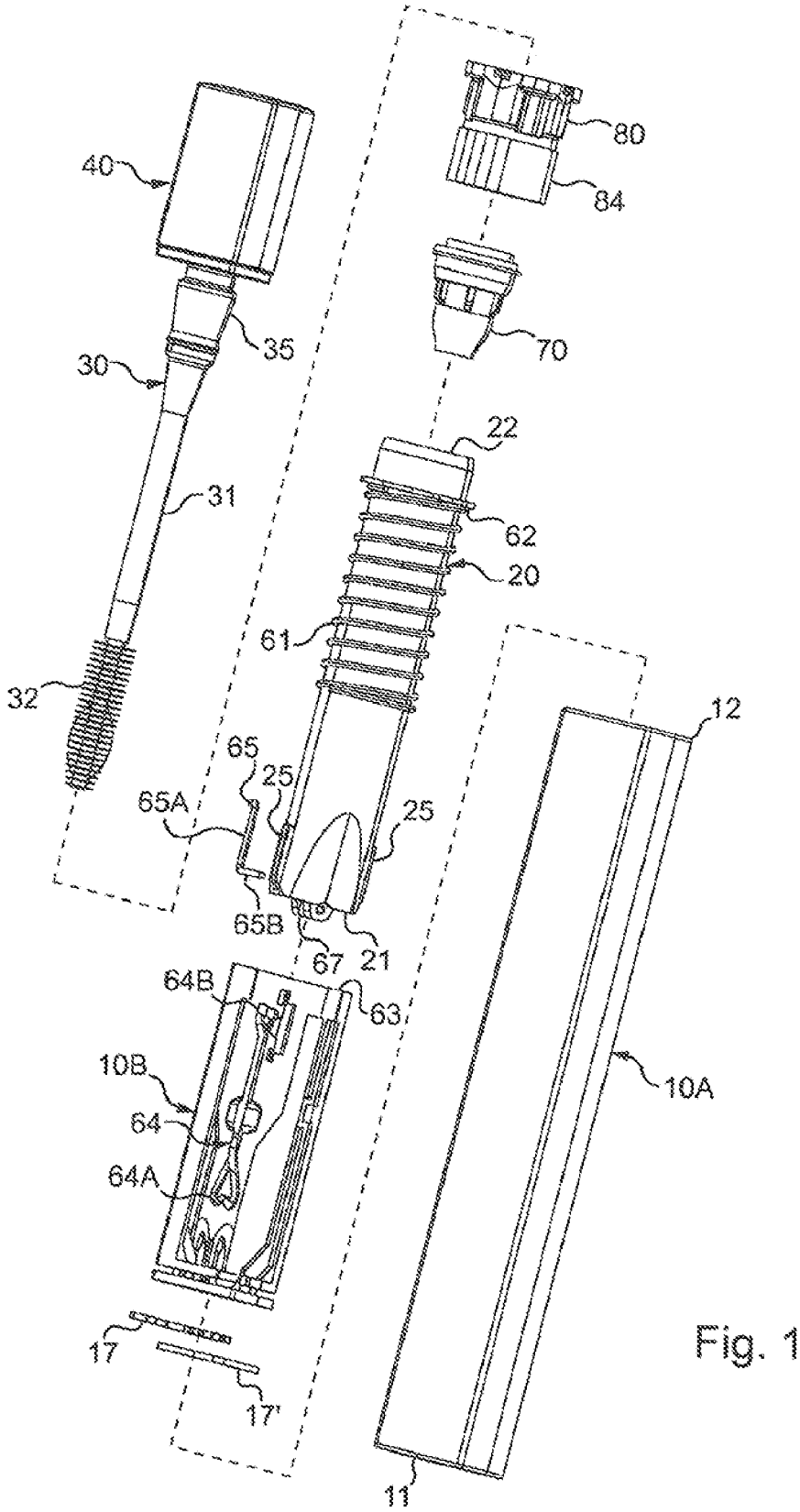
FIG. 1 is an exploded perspective view of a mascara container in accordance with invention.

The container of FIG. 1, represented under the general reference 1, is a mascara container which principally comprises:

an elongate body, extending in a longitudinal direction which is vertical here, provided with a bottom zone 11 and a free edge 12, a reservoir 20 containing mascara comprising a bottom 21 and a neck 22, and adapted to be entirely contained in the body while being movable in translation therein between a low resting position and a high working position, an application member 30 comprising a shaft 31 terminating by an applicator 32 adapted to be loaded with product when it is plunged into the reservoir in a reloading configuration relative to that reservoir in which the shaft passes through the neck 22 of that reservoir, a cap 40 joined to the application member 30 and adapted to engaged within the body, until it reaches a configuration in which it is substantially retracted (giving at most a very slight grip to the fingers of a user, insufficient to enable its inadvertent, accidental extraction out from the body, when the container is in a bag, or in a pocket).

The body may be formed by one or more parts joined to each other; in the example considered here the body comprises a tube 10A of some particular cross-section (circular, rectangular, polygonal or other), open at both ends, and a mounted-on cage-forming part 10B adapted to be put into place, permanently, in the low part of that tube, in particular so as to constitute a bottom face for that tube; this cage here comprises a longitudinal slot 14 and longitudinal apertures 15. This configuration in two parts enables the materials constituting the two parts 10A and 10B to be chosen independently, for example a metal material for the tube and a plastic material for the part 10B. Of course, as a variant not represented, the body may be formed as a single part, for example obtained by molding.

An elastically compressible guide device is interposed between the body 10A+10B and the reservoir 20. This device comprises:

a spring 61 disposed between two respective contact surfaces of the body 10A+10B and of the reservoir 20; these contact surfaces are constituted here by an annular portion 62 joined to the reservoir, here surrounding the upper part of the reservoir close to the neck 22, and a contact surface 63 joined to the body 10A+10B, constituted here by the upper edge surface of the mounted-on cage 10B (given the geometry of this mounted-on cage, this upper edge surface is C-shaped), two complementary portions separately distributed between the body and the reservoir, i.e.:

a hollow guide track 64 generally disposed in the longitudinal direction of the body and, a follower finger 65 engaged in that guide track, The hollow guide track 64 is carried here by the body, more particularly by the mounted-on part 10B whereas the follower finger 65 is carried by the reservoir. It can however be understood that the situations may be swapped, in a variant not represented.

This hollow guide track 64 comprises two end portions 64A and 64B, each comprising a corner-shaped zone adapted to constitute a stable position for the follower finger. More particularly, these two corner-shaped zones are oriented in the same direction, one of these extreme portions, 64A, comprising a W-shaped zone the central part of which forms the corresponding corner-shaped zone; the spring 61 is disposed so as to urge the follower finger towards one or other of those corner-shaped zones; this will be detailed with reference to FIGS. 2 and 3.

The follower finger 65 is preferably mounted at the end of an arm 65A, which is oriented generally parallel to the longitudinal direction of the container, and of which the other end 65B is articulated to the portion which carries that follower finger.

In the example considered here in which the follower finger is carried by the reservoir, the end 65B of the arm is bent so as to be able to be articulated under the bottom 21 of that reservoir.

Given that the spring urges the reservoir outwardly of the body, the follower finger is urged by that reservoir outwardly, which explains why the corner-shaped zones A and B of the hollow guide track which define stable positions for that follower finger are oriented (that is to say that they point) outwardly; in case the follower finger is carried by the body whereas the hollow guide track is carried by the reservoir, the corner-shaped zones of the guide track should be oriented towards the bottom of the body.

Figure 2:
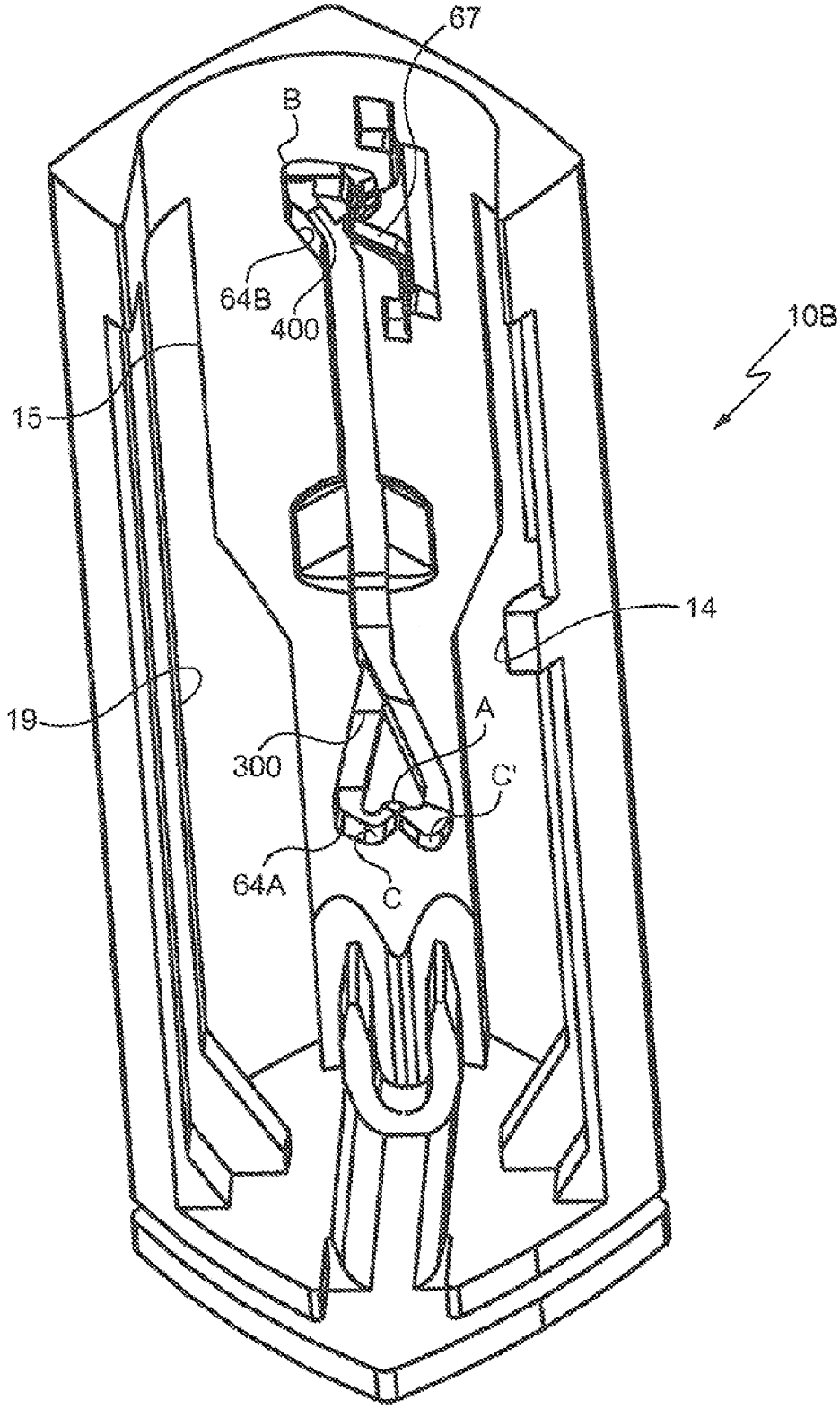
FIG. 2 is a perspective view of the cage engaged in the body of the container of FIG. 1.
Figure 3:
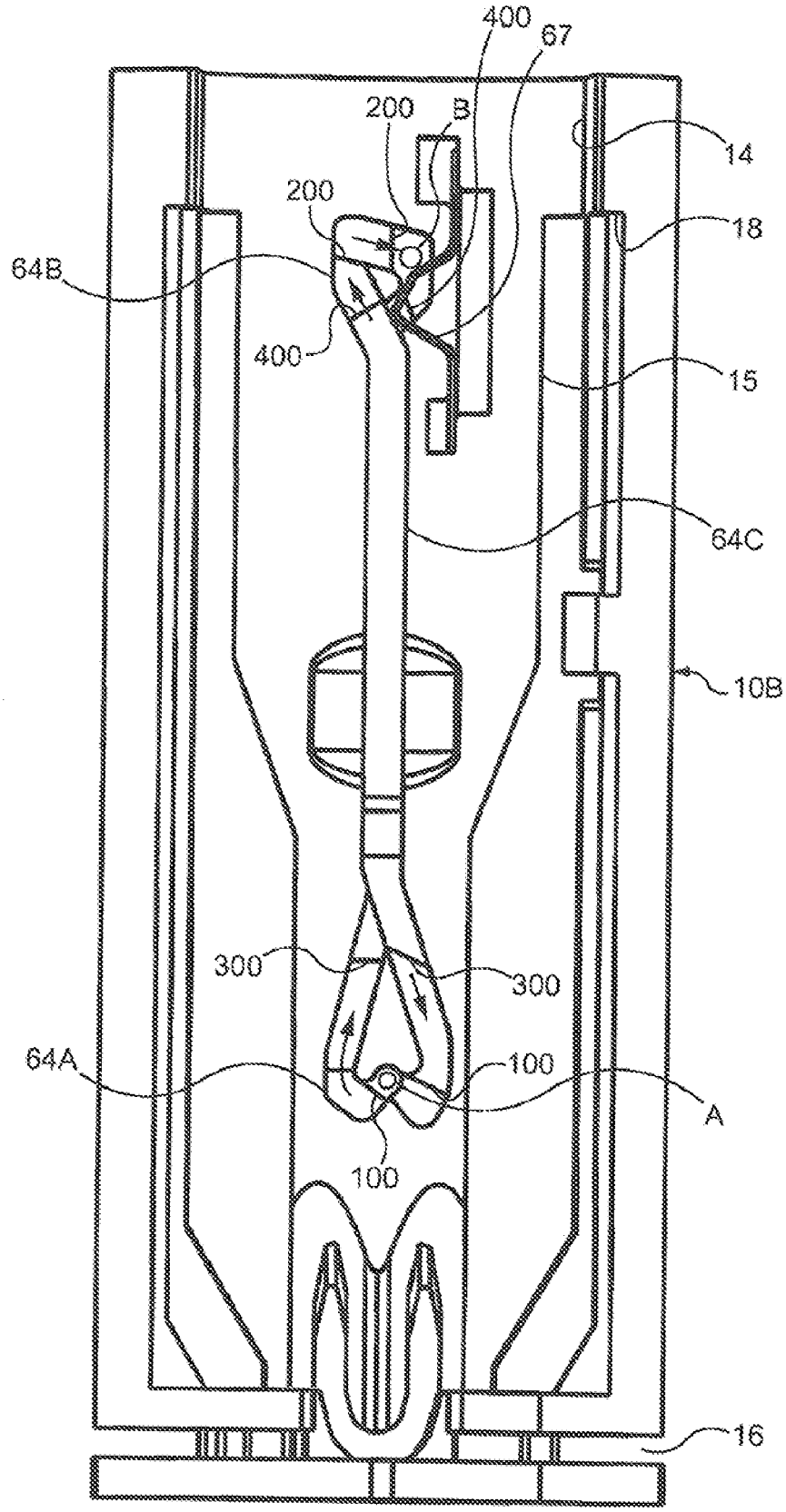
FIG. 3 is a view in elevation.

The details of the hollow guide track are given by FIGS. 2 and 3.

It can be understood that, when the follower finger is in the corner-shaped zone of the portion 64A, identified by the letter A, it is in a stable position such that the reservoir remains stably in a stable maximum pushing-in configuration, whereas, when the finger is in the corner-shaped zone of the portion 64B identified by the letter B, the reservoir is in a stable minimum pushing-in configuration. In fact, the finger has at least one other low position, defining for the reservoir a configuration of greater pushing-in than that defined by the letter A (these low positions, denoted C and C', are situated at the base of the two V's forming the aforementioned W-shaped zone; but this is an unstable configuration. More particularly, by pushing down on the reservoir against the spring, the finger can be brought into one of those hollows C or C' of the W-shaped portion, and then be enabled to follow the guide track until it reaches the position marked by the letter B.

In practice, non-return steps 100 are formed at the bottom of the end portion 64A of the hollow guide track to ensure that, in case the reservoir is pushed towards the bottom, the finger selectively engages in only one of the hollows, here the hollow on the right; it suffices for this to provide an increase in depth of the track at the location of the steps 100; a release of the pressing on the reservoir then enables the reservoir to attain the configuration defined by zone A; pressing again on the reservoir causes the finger to pass by the hollow on the left, then to rise towards the high end portion 64B.

It may be understood that the axial position of the follower finger when it passes such a hollow C or C' constitutes a neutral pushing-in position which it is necessary to pass to go from position A to position B and vice-versa (in practice the two hollows C and C' of the W-shaped portion are at substantially identical levels relative to the body).

Similarly, the other corner-shaped zone, marked by the letter A in the high end portion, is provided with non-return steps 200 ensuring that the finger, in case the reservoir is pushed in from the configuration in which the finger is in that position B, necessarily follows one of the return portions towards the portion 62A here the right branch.

It is thus apparent that the elastically compressible guide device, situated between the body and the reservoir, has a stable retracted configuration determining the low resting position of the reservoir and a maximum extension configuration determining the high working position of that reservoir, the passage of the device from one to the other of those configurations being made by retraction beyond the stable retracted position against a spring, the device comprising, on one of the body and the reservoir, a hollow guide track disposed generally in the longitudinal direction of the body, and, on the other of the body and the reservoir, a follower finger engaged in that hollow guide track, at least when the device is in its maximum extension configuration.

It can be understood that the cooperation of the follower finger and the corner-shaped zone A of the low end portion determines the low resting position of the reservoir. On the other hand, advantageously, the cage 10B is advantageously designed to comprise mechanical abutments defining, with complementary contact surfaces provided on the reservoir, the high working position of that reservoir; this avoids the follower finger being urged (in any case, not excessively so) into that high position. These abutments are shoulders 18 here provided along the longitudinal slot 14 of the cage 10B, and the contact surfaces adapted to come to cooperate with these abutments in the high position of the reservoir are constituted by the annular contact surface on which the spring comes to bear.

According to an aspect of the invention, it is possible for the spring not to be dimensioned to enable it, by itself, to cause the movement of the finger from the position A until it reaches the position B; more particularly, a mounted-on elastic member 67 is provided in the vicinity of the track, close to that corner-shaped zone B to brake the passage of the finger from that position B in the direction of the position A. It can be understood that, even if the movement of the finger to reach the position B was obtained by the particular action by the user on the container, taking over from the spring thrust, the follower finger normally remains in that position B until the user makes an opposite movement to that which brought the follower finger into that position B, by applying a sufficient force to get past that elastic member. To be precise, it suffices for the spring to be sufficiently powerful to force the reservoir to push the cap to project from the body by a sufficient distance to enable grasping thereof by the fingers of a user.

This mounted-on elastic member, here an elastic strip, is advantageously disposed relative to the track so as to encroach on the volume swept by the follower finger when it moves from its position B to the position A, which implies that this movement requires the application of a sufficient force to deform that blade, which it is easy to calibrate so as to be substantially greater than the mere weight of the reservoir, as well as moderate thrusts which may be applied to the reservoir at each operation of reloading the applicator with product (in particular to pass the wiper which a mascara container typically comprises, but which may be omitted according to the applications); this ensures that the finger is kept in its position despite gravity.

It will thus be appreciated that the role of the follower finger, at A, is to cooperate with the corner-shaped zone of the W-shaped portion for retaining the reservoir in its low resting position and, at B, is to cooperate with the mounted-on elastic member to constitute a "resistant" point to pass when the user wishes to pass the reservoir from its high working position to said low resting position.

Advantageously, the end portions 64A and 64B of the hollow guide track are connected by a single intermediate track 64C; however, as a variant not represented, these end portions may be connected by sections of parallel track, respectively destined for the ascent, and the descent, of the follower finger between those high and low end portions.

More particularly, the low W-shaped portion advantageously forms a larger heart-shaped portion (here inverted) whereas the high portion forms part of a larger drop-shaped portion, these heart- and drop-shaped portions having pointed joining zones joining to that single intermediate portion 64C. By analogy with what was stated with regard to the corner-shaped zones, the junctions of the heart- and drop-shaped portions with the intermediate portion are provided with non-return steps 300 and 400 which ensure a guiding effect on the follower finger to make it follow, when it leaves that single intermediate portion, the appropriate branch of the heart or drop shape.

It may be noted, in FIG. 1, that the arm 65B which carries the follower finger 65 operates in compression when the follower finger is in its stable position A. This contributes to enabling a substantial part of the assembly of the elastically compressible device to be situated between the lateral walls of the reservoir and of the body, this makes it possible maximize the volume of the reservoir in the inside volume of the body despite the presence of that device.

The guiding of the movement of the reservoir between its high and low positions may be provided solely by the cooperation of the follower finger with the hollow guide track.

However, advantageously, this guiding is completed by the cooperation of runners referenced 25, here formed on the reservoir, with ribs or ridges 19, here formed on the cage 10B. Thus, the elastically compressible device, possibly completed with these members 19 and 25, constitutes an elastically compressible guide device.

According to still another variant, the entirety of the hollow guide track is heart-shaped, of which the W-shaped part constitutes the low end portion and the point constitutes the high end portion.

It has been stated that part of this device is mounted on the mounted-on part 10B. One advantage of the body comprising such a mounted-on part is that putting that device in place between the mounted-on part and the reservoir may be done outside the tube 10A and that the engagement in the tube 10A of the assembly 10B+20, with the members of the elastically compressible device ensures that these members are kept in place in configuration for cooperation with that mounted-on part and that reservoir.

It is in particular to facilitate the putting in place of the reservoir in the cage, conjointly with the spring and the follower finger, at the end of its arm, that this mounted-on cage advantageously has the shape of a sleeve having (see in particular FIG. 2) a longitudinal slot 14 facing the inside zone of that sleeve where the hollow guide track is provided (this cage thus has a generally C-shaped cross-section). Thus, when the bend 65B of the arm 65A has been positioned in an appropriate channel of the bottom of the reservoir, the transverse engagement of the reservoir through the slot enables the follower finger to be positioned in any zone of the hollow guide track, it then suffices to engage the assembly axially in the tube to ensure the holding in pace of the arrangement so obtained.

The longitudinal slot 14 may have an identical width to the width of the inside volume of that sleeve, which enables easy engagement of the reservoir in that sleeve. As a variant, the slot is slightly narrower, which enables engagement that is almost as easy, while then providing a holding effect, while the assembly is positioned in the tube 10A.

The lateral apertures 15 which may advantageously be provided in the residual wall of the sleeve, spaced away from the slot 14, enable the sleeve to be lighter while providing access to the inside of the sleeve and to the members which must be implanted therein.

The sleeve advantageously comprises a bottom formed so as to be complementary to the form of the bottom of the reservoir, taking account of the presence of the bend of the arm carrying the follower finger 63.

Figure 6:
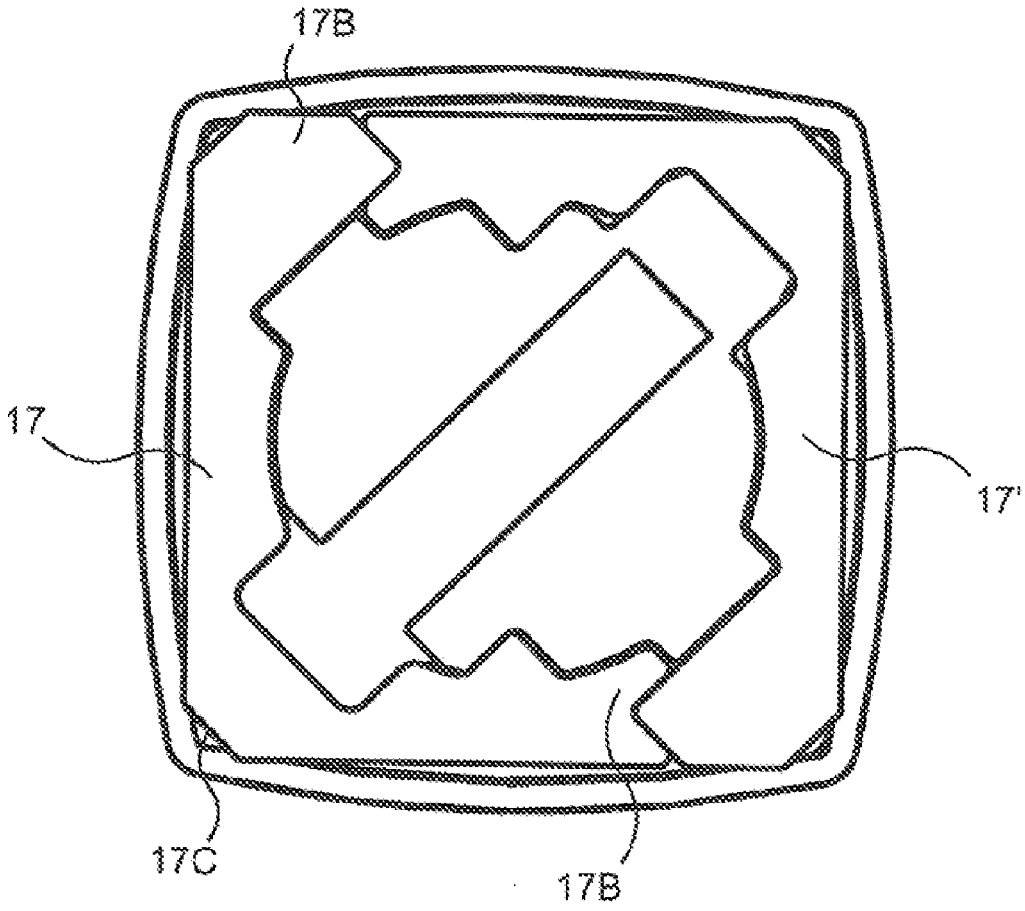
FIG. 6 is a view from below of the container of FIG. 1.

The presence of a transverse slot 16 in the thickness of the bottom may be noted in FIG. 3. This transverse slot enables two C-shaped parts 17 and 17' to be put into place which are adapted to cooperate, when the sleeve is engaged in the tube, to anchor themselves by their rear portion 17A in the inside wall of the tube, while bearing on each other by their ends 17B (see Ia FIG. 6).

Figure 4:
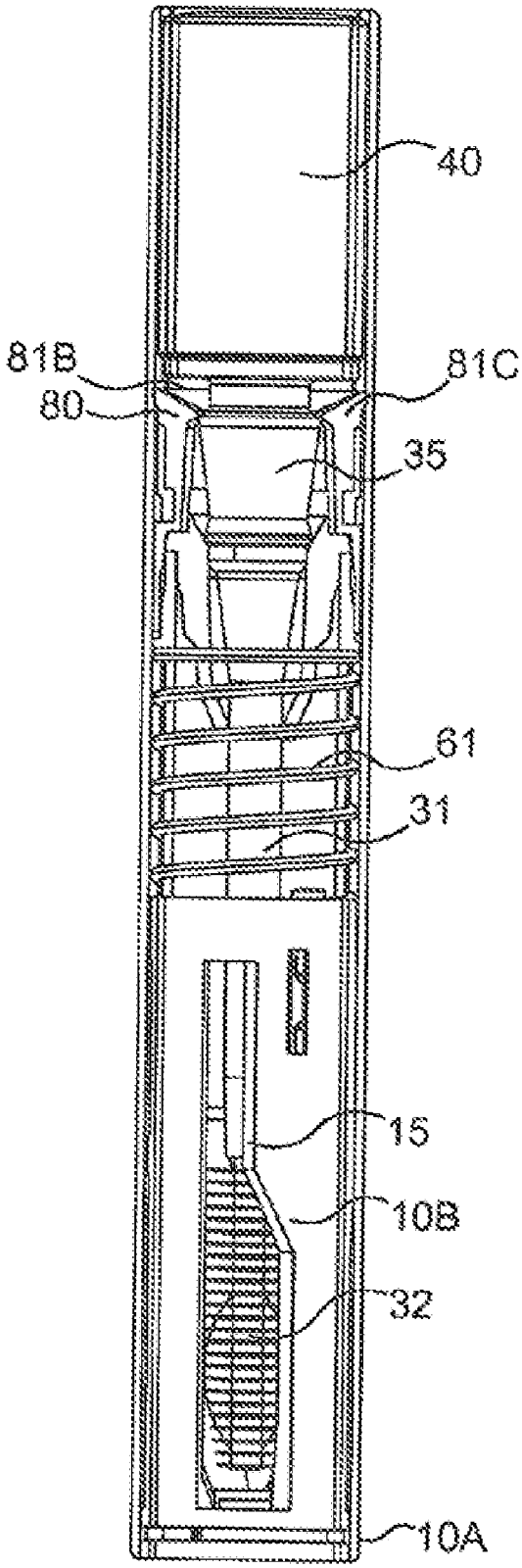
FIG. 4 is a view in elevation with a partial axial cross-section of the container of FIG. 1, in a configuration in which the cap is in a maximum pushing-in position in the body.
Figure 5:
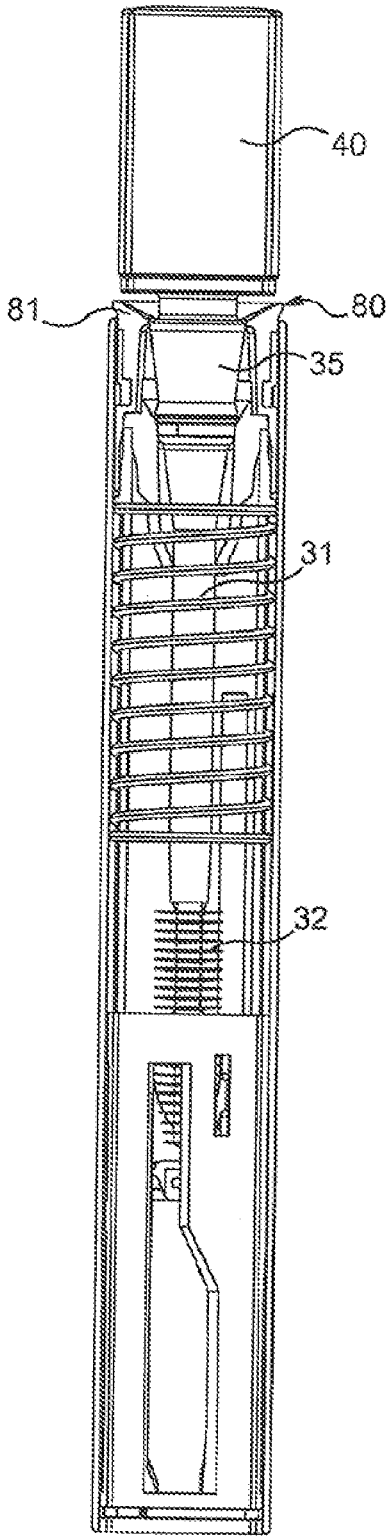
FIG. 5 is another view in elevation with a partial axial cross-section of that container in a configuration in which the cap is to the outside of the body container.

FIGS. 4 and 5 represent the container of FIG. 1 after assembly.

In FIG. 4, the cap and the assembly of the application member are retracted into the body, more precisely, it can be seen that the free face of the cap is flush with the free edge of the body. As indicated above, this retraction does not need to be full, provided that the cap does not give a sufficient grip to be snagged inadvertently by an object contained in a bag or a packet.

In this configuration, the follower finger is in position B of FIG. 3.

When the user wishes to apply mascara, she presses on the free face of the cap, so as to enable the follower finger to pass the appropriate hollow C or C' of the W-shaped portion, and thereby enable the spring to raise the reservoir, taking advantage of the fact that the finger, after having passed the aforementioned hollow, can escape towards position B. Since the application member then bears against the reservoir, it follows that the rising of the follower finger which enables the rising of the reservoir also enables the rising of the application member, including its cap. The user can then grasp the cap and continue, if necessary, the raising thereof until the reservoir is brought to its maximum extraction position; the finger is then in its position B and remains there on account of the presence of the mounted-on elastic member.

It is worth noting here that the reservoir and the shaft of the application member are advantageously provided with complementary axial members for linking the reservoir and that application member while the reservoir has not reached its maximum extraction position. These complementary axial linking members advantageously perform a sealing function.

As shown by FIG. 1, two parts are adapted to be mounted situated at the neck of the reservoir 20 (in practice joined, i.e. definitively).

- a wiper-forming part 70, adapted to engage in the top part of the reservoir across its neck, and
- a sealing part 80, adapted to engage on the end of the reservoir so as to cap the wiper forming part, and adapted to cooperate with a protuberance 35 carried by the shaft of the application member.

The wiper forming part has the purpose of controlling the quantity of product that comes out with the applicator, when the user takes the application member out of the reservoir. It is typically a part of flexible material capable of wiping the applicator in controlled manner; this part thus in practice has a form defined by the form of the applicator. This wiper-forming part comprises a constriction 71 forming a sealing contact surface adapted to cooperate with the aforementioned protuberance 35 by forming a seat against which the protuberance 35 comes to bear when the application member is in its reloading configuration in the reservoir; under that constriction a wiping lip 72 is situated of any known appropriate type.

More particularly, the protuberance comprises a sealing portion 35A, advantageously provided with a seal, adapted to be applied axially against the sealing contact surface 71. Advantageously, the sealing contact surface is completed by a plug-forming portion 35C adapted to engage in the wiper-forming part 70, beyond the constriction.

The protuberance 35 has a body 35B having a frusto-conical general shape flaring out towards the cap and comprising, spaced away from the sealing portion 35A towards the cap, a transverse contact surface 35D.

The sealing part 80 comprises a collar which is formed, along its circumference, with a plurality of rigid sectors 81 and flexible sectors 82, by virtue of which it has a relaxed configuration in which it is of larger transverse size than the inside cross-section of the body and a restricted configuration in which, by compression of the flexible sectors, it is confined within the internal volume of the body. These rigid sectors are advantageously connected by flexible portions to a rigid crown 84 constituting the low part of the part 80. With regard to the flexible sectors, they are advantageously obtained by over-molding of the crown and of the rigid sectors integrally formed with it.

At least the rigid sectors 81 comprise, along the inside edge of the collar, rims 81B adapted to come into engagement axially against the transverse contact surface 35D of the protuberance 35. Advantageously, rims 82B are also provided on the flexible sectors. Furthermore, these sectors advantageously comprise outside rims 81C, or even 82C.

In fact, the crown 84 constituting the low portion of part 80 is a skirt of which the axial dimension enables the axial distance between the rims 81B and the constriction 71 to be set such that the coming into engagement of the rims 81B against the transverse contact surface of the protuberance 35 is obtained when the sealing portion 35A is applied against the sealing contact surface 71 until the seal possibly provided in the zone 35A is compressed; the coming into engagement of the rims against that transverse contact surface thus provides the holding in position of these sealing members.

As a variant, the protuberance is, at least as regards its part 35A, formed from a material capable of being elastically compressed when the protuberance comes against its seat in part 80.

A complementary function of this cooperation between the rims 81B and contact surface 35D is that this cooperation provides axial linkage between the reservoir and the application member while the collar is maintained in its restricted configuration, which enables an extraction movement applied by a user to the cap, and thus to the application member, to be transferred to the reservoir so as to provide for it the end of its rise until it reaches its high working position, independently of the force of the spring 61.

Figure 8:
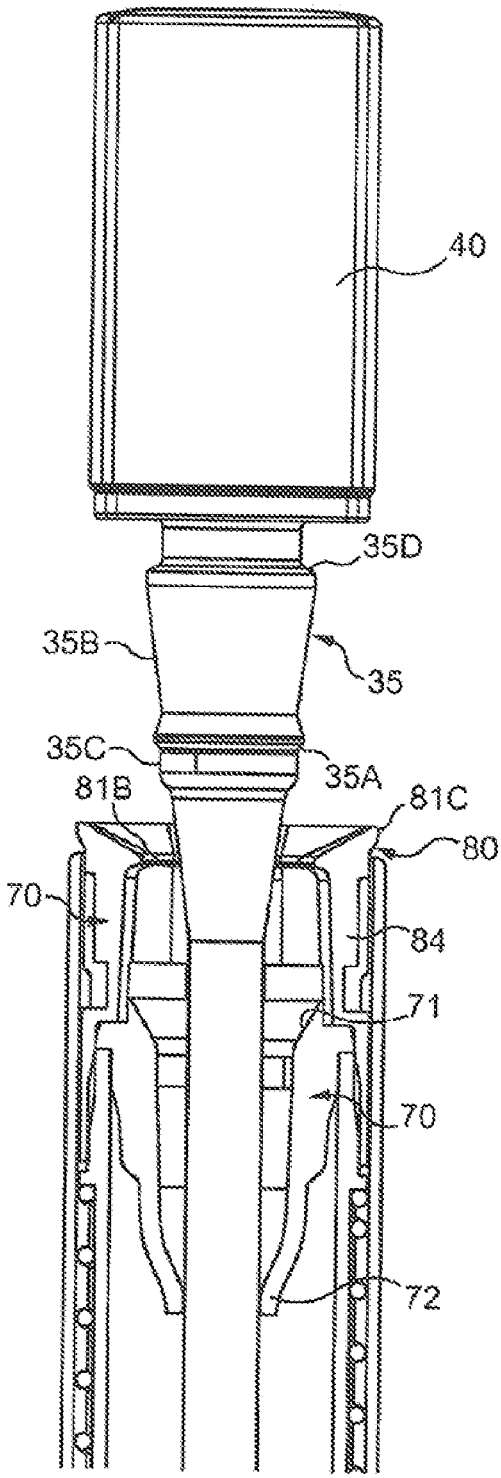
FIG. 8 is a partial view in cross-section of the container of FIG. 1 in a configuration in which the application member is partly engaged in the reservoir.

FIG. 8 represents a configuration in which a user has partially engaged the application member in the reservoir, that is to say that the shaft has already passed through the parts 70 and 80, and the protuberance is on the point of engaging within the part 80. The collar is in its relaxed configuration.

By passing through the wiper-forming part 70, the applicator has encountered a resistance but the reservoir did not move; this is because the resistance generated by the wiper is less than the resistance of the resistant point between the reservoir and the body.

Figure 9:
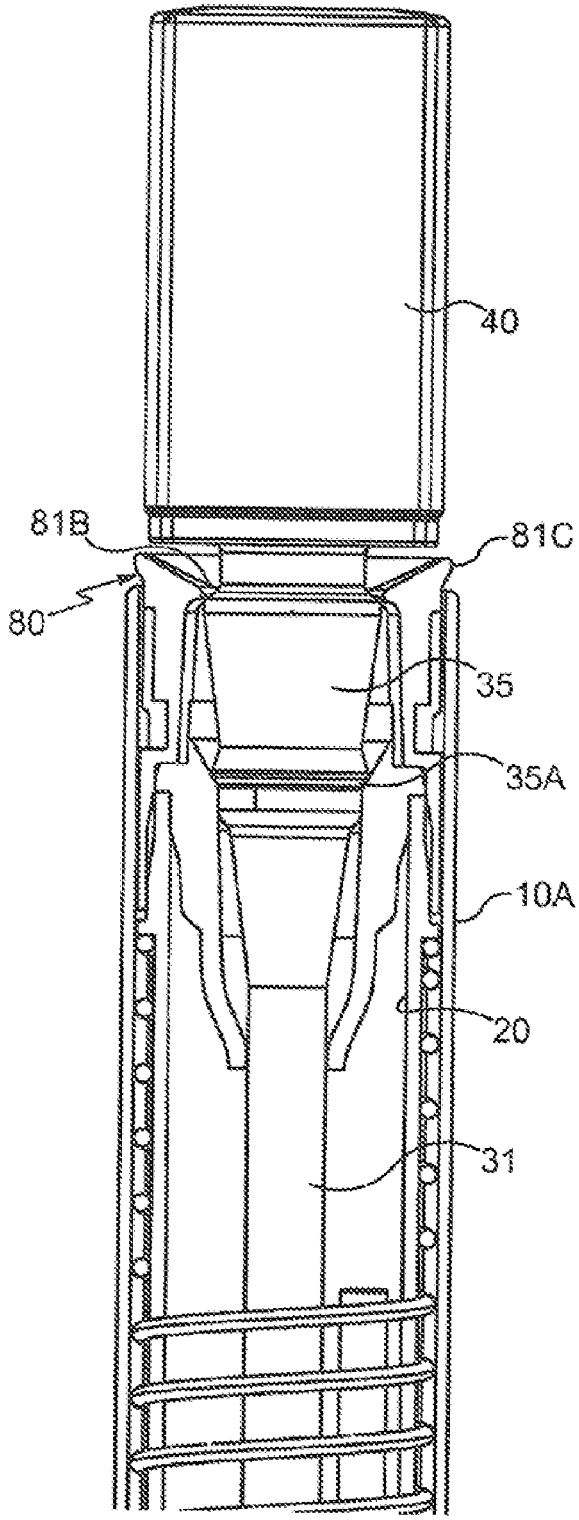
FIG. 9 is a similar Figure, in a configuration in which the application member bears against the reservoir.
Figure 10:
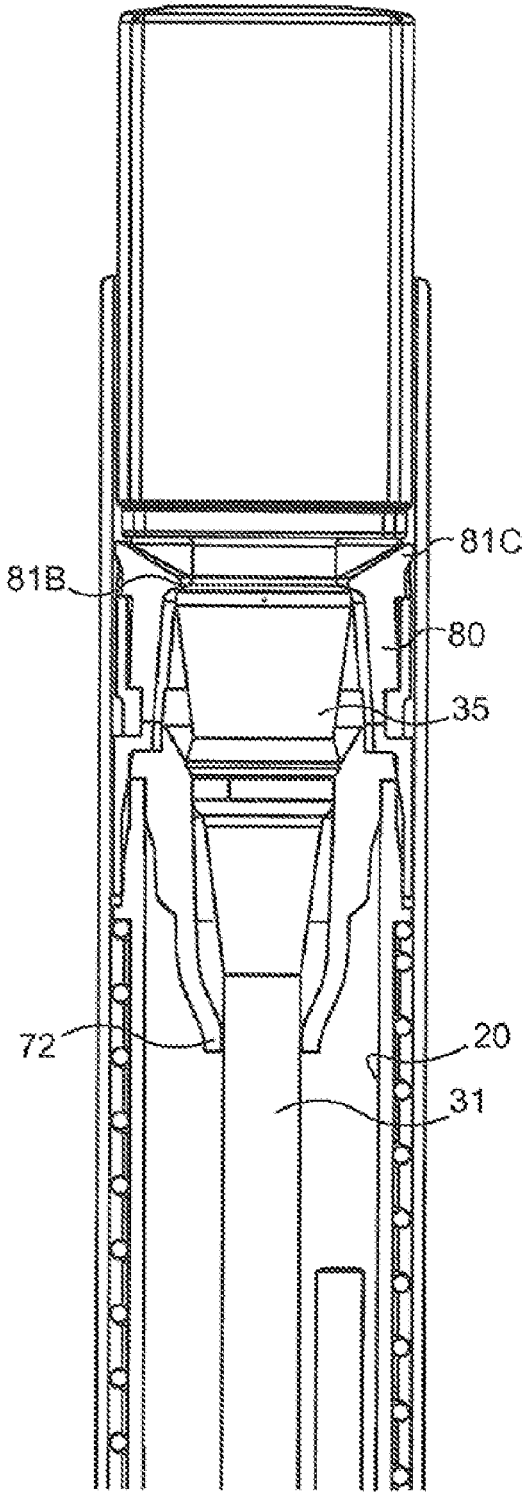
FIG. 10 is a similar Figure, in a configuration in which the entirety of the application member and of the reservoir are in course of being pushed in towards the bottom of the body.

Continuation of the pushing in movement (see FIG. 9) brings the sealing portion of the protuberance against the sealing contact surface 71 while the skirt of part 80 engages within the body, the effect of which is to commence the confinement effect of the collar; the inside rims 81B are then axially at the level of the rear transverse contact surface of the protuberance. Together with the free edge of the body the skirt provides a ramp effect, amplified by the presence of the outside rims 81C, and even 82C, to cause, together with the free edge of the body, the deformation of the collar until the restricted configuration is attained. It is in this manner that the descent of the reservoir into the body causes the entry of the collar into the body, which causes the coming towards each other of the rims 81B and thus the coming into engagement thereof along the transverse contact surface 35D (FIG. 10): the collar is then in its restricted configuration.

The confinement of the collar within the body requires a force from the user, which is added to the force necessary to pass the mounted-on elastic member. The fact that this elastic member is a mounted-on member makes it possible, by choosing a member of appropriate stiffness, to regulate the magnitude of the force to apply to succeed in causing the beginning of the descent of the reservoir into the body.

Figure 11:
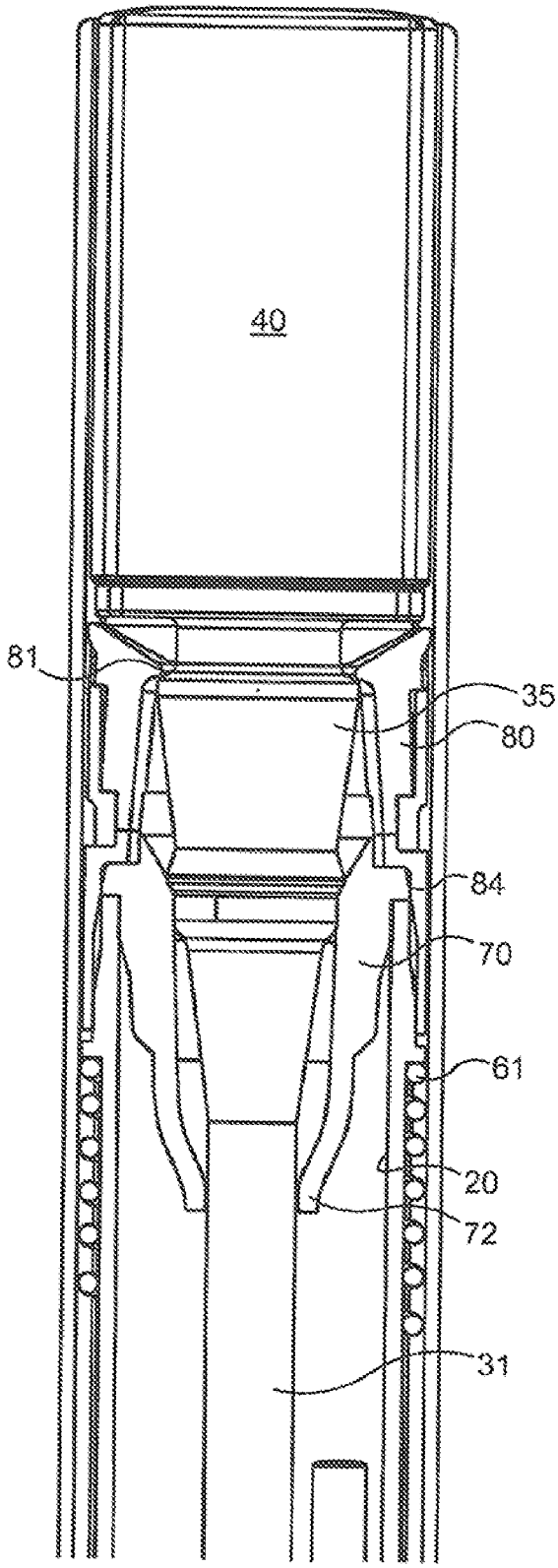
FIG. 11 is a similar Figure, in the maximum pushing-in configuration of FIG. 4.

This movement continues until the reservoir reaches its maximum pushing-in configuration, corresponding here to a flush retraction of the cap in the body (FIG. 11).

FIGS. 12 to 15 partially represent a variant embodiment of a container in accordance with the invention, which is distinguished from the container described above by the structure of the elastically compressible device, in particular with regard to its part where the follower finger is situated when the reservoir is in its high working position.

The elements of the container which are similar to those of the container described above are designated by reference signs which are deduced from those used for the container above by the addition of the number 500.

Figure 12:
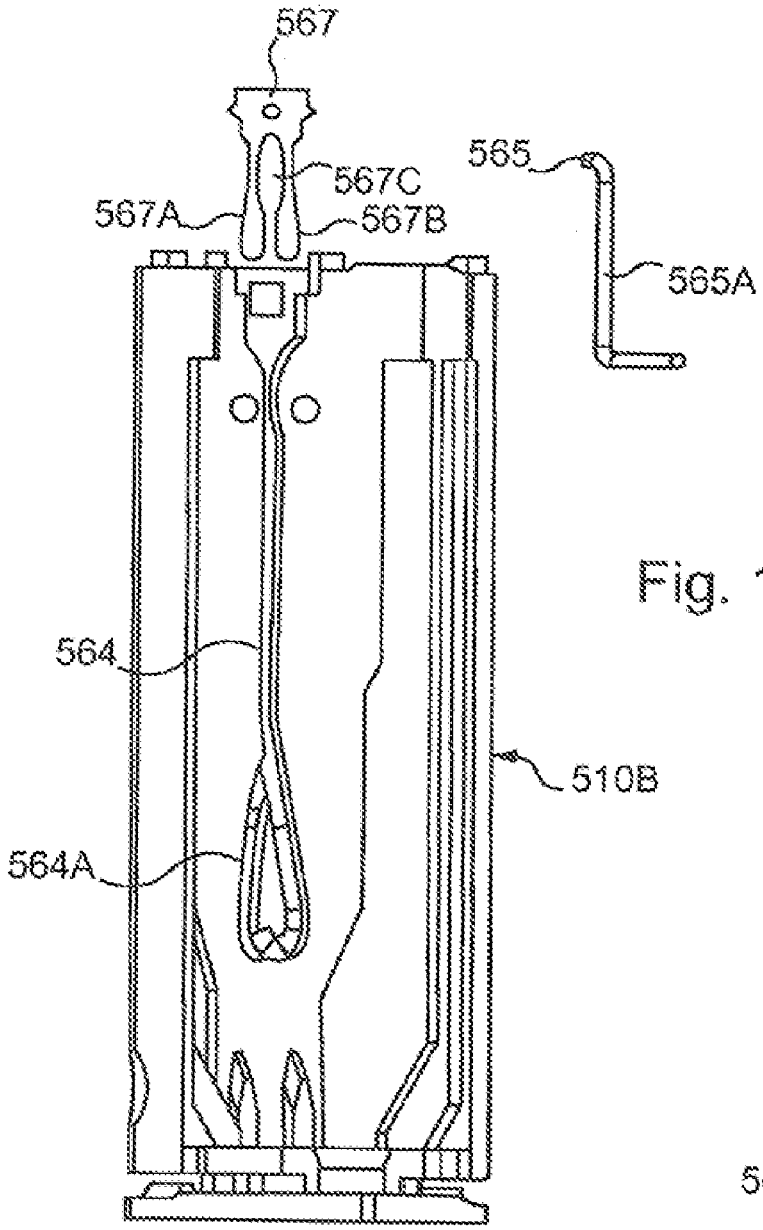
FIG. 12 is an exploded partial view in elevation, of another embodiment of a container in accordance with the invention, comprising another configuration of the guide members.

Thus the guide track 564 of FIG. 12 comprises a low end portion 564A having the same geometry as that of FIGS. 2 and 3. However, the high end portion 564B, connected to the portion 564A by a single portion 564C, has a geometry differing from the drop shape of FIGS. 2 and 3 by the fact that this high end portion is a longitudinal section of track in the bottom of which there is formed a cavity 564D (see FIG. 15). This cavity connects to the bottom of the hollow guide track by a ramp 564E the role of which will become apparent later. In the example represented, the guide track widens at the location of that cavity.

In that cavity a mounted-on part 567 is engaged having the shape of a U of which the branches 567A and 567B are longitudinally oriented downwards, that is to say towards the rest of the guide track. These branches are conformed so as to form a space 567C between them able to receive the follower finger. These branches comprise projections towards each other, so as to form, at the axially opposite end to the base of the U, a constriction of smaller width than the width of the follower finger, such that escaping from that space by the finger can only be done by forcing the branches to separate until the constriction has widened until the width of that follower finger has been attained.

The thickness of this mounted-on part is such that its face that is oriented inwardly of the cage is substantially flush with the bottom of the rest of the track when it is in place in the cage.

This U-shaped part is engaged in a slot formed in the thickness of the cage 510B (see FIG. 14, in which only one lateral flank of the guide track is represented), such that, when the finger tends to move the branches apart, their deformation actually occurring parallel to the wall of that cage is avoided.

The follower finger is elastically urged towards the bottom of the cavity, transversely to the longitudinal direction of the container, for example as a consequence of the choice, for the arm 565A of an elastic material and of an assembly with appropriate pre-stressing.

When the reservoir is in its high working position, the follower finger is engaged in the space formed between the branches of the U-shaped part, and between the bottom of that U and the constriction formed by those branches.

Figure 15:
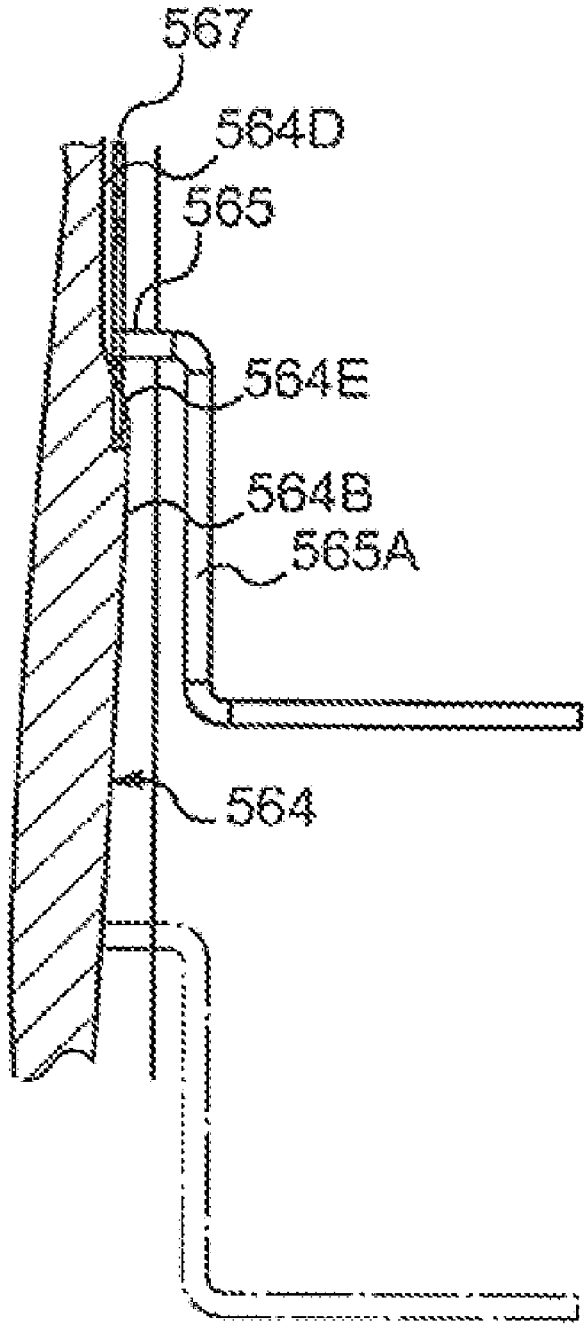
FIG. 15 is a detail view in cross-section of that other embodiment showing two positions of the follower finger relative to the hollow guide track.

As is apparent from FIG. 15, when the reservoir is subjected to a pushing-in force, that force is transmitted by the reservoir to the follower finger which is thus urged longitudinally downwardly. Given the presence of the constriction, the finger cannot freely come out from that space, and a force must be applied to it which is sufficient to force the moving apart of the branches. While that finger is starting to come out from that space, or after it has come out therefrom, the ramp 564E tends to force the finger to recede (transversely towards the axis of the reservoir), so as to return to the level of the bottom of the rest of the guide track. Continuation of the movement imposed on the reservoir requires a smaller force, since it suffices to make the finger slide along the track to attain its low end portion, where the follower finger may be retained in the same manner as in the container described above. In FIG. 15, the follower finger is represented, in chain line, in a configuration in which it can slide normally on the bottom of the track.

When the user wishes to raise the reservoir to its high position, it suffices for her to apply a sufficient push to enable the spring to cause at least a start of a rise, to an extent to enable her to grip the cap so as to bring the reservoir to its high position. At the end of the movement, the fact that the branches of the mounted-on part are substantially flush with the bottom of the rest of the guide track has the advantage that the follower finger can slide over the branches, without entering them, until it engages, by latching, in the space situated between the branches, near the bottom of the U shape; the branches may thus be passed, on rising, without meeting resistance.

In other words, the branches of the U-shaped part constitute a point of resistance to pass for the follower finger only in the direction of descent of the reservoir into the body.

In the example in which the follower finger is carried by an arm, the pressure by which the finger is applied towards the bottom of the track is advantageously obtained by the prestressing with which the arm is mounted.

As a variant, that follower finger, denoted 565', may be mounted on an elastic blade 565A' which is bowed so as to provide such a transverse pre-stress away from the inside of the reservoir.

Figure 16:
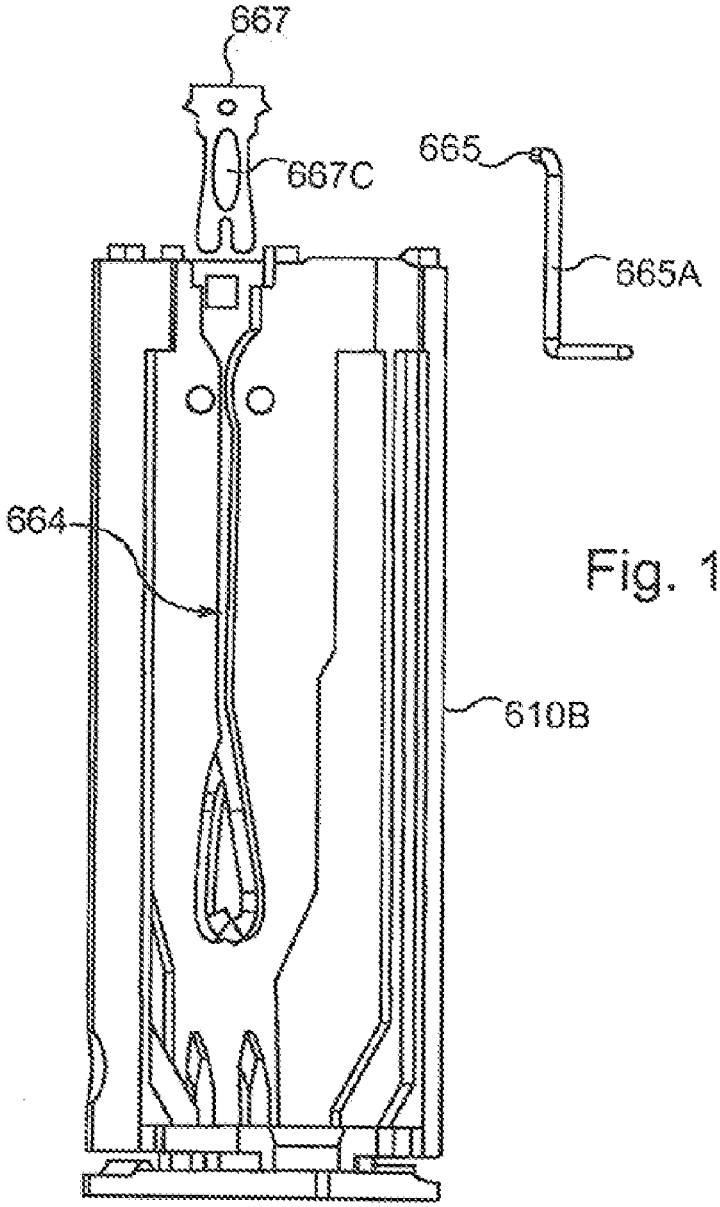
FIG. 16 is a similar view to that of FIG. 12, according to still another embodiment.
Figure 17:
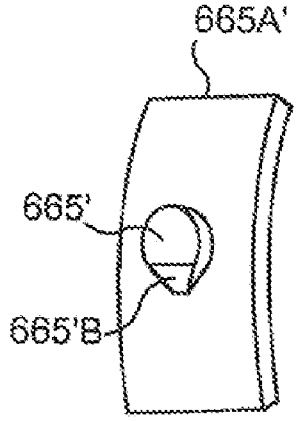
FIG. 17 is a perspective view of a variant embodiment of a follower finger which that other embodiment comprises.
Figure 18:
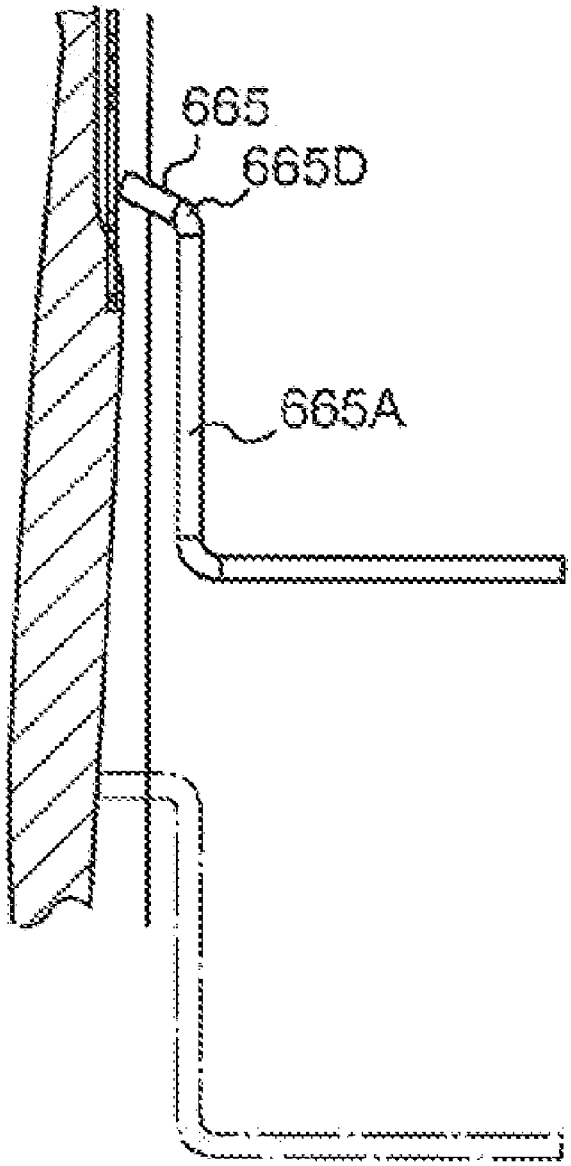
FIG. 18 is a similar view to that of FIG. 15, showing two configurations of that other follower finger.

FIGS. 16 to 18 represent another variant embodiment, of which the parts similar to those of FIGS. 12 to 15 are designated by references which may be deduced from the ones used on those Figures by the addition of the number 100.

Thus FIGS. 16 to 18 describe, in part, a container which differs from that of FIGS. 12 to 15 by the fact that the U-shaped part is replaced by a mounted-on part comprising a closed aperture 667C, here with branches which are linked to each other remotely from the bottom of the U, so as not to be able to move apart.

In this case, the operation of the elastically compressible guide device is substantially the same, the difference being that, to escape out of the space 667C, the follower finger must recede until it comes to the level of the face of that part which is oriented towards the reservoir.

The follower finger 665 is advantageously connected to its arm 665A by a flexible portion 665D, by virtue of which the follower finger can incline towards the longitudinal direction of the container, so as to be able to escape out of the space 667C. In this case, the effect of the inclination of the follower finger is that the lateral wall of the finger may act as a ramp to be able to leave that space.

Figure 13:
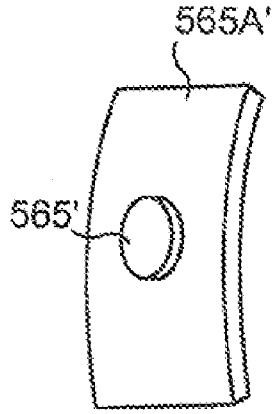
FIG. 13 is a perspective view of a variant embodiment of a follower finger which that other embodiment comprises.
Figure 14:
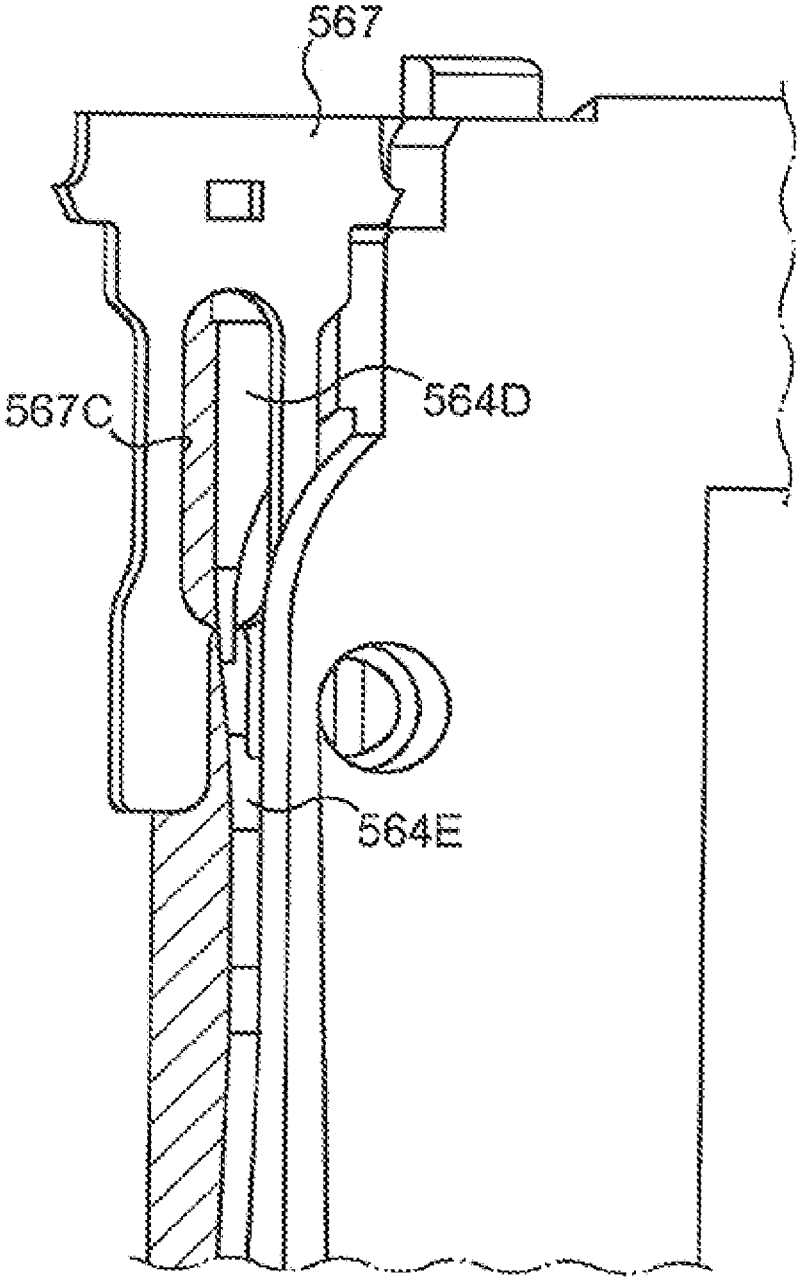
FIG. 14 is a detail view of that other embodiment after putting in place the elastic member represented in FIG. 12.

FIG. 17 represents a variant of the follower finger of FIG. 13, in which the follower finger, carried by an elastically flexible strip 665A', comprises an inclined flank adapted to constitute a ramp 665'B facilitating the exit of the follower finger from the space 667C.

Figure 7:
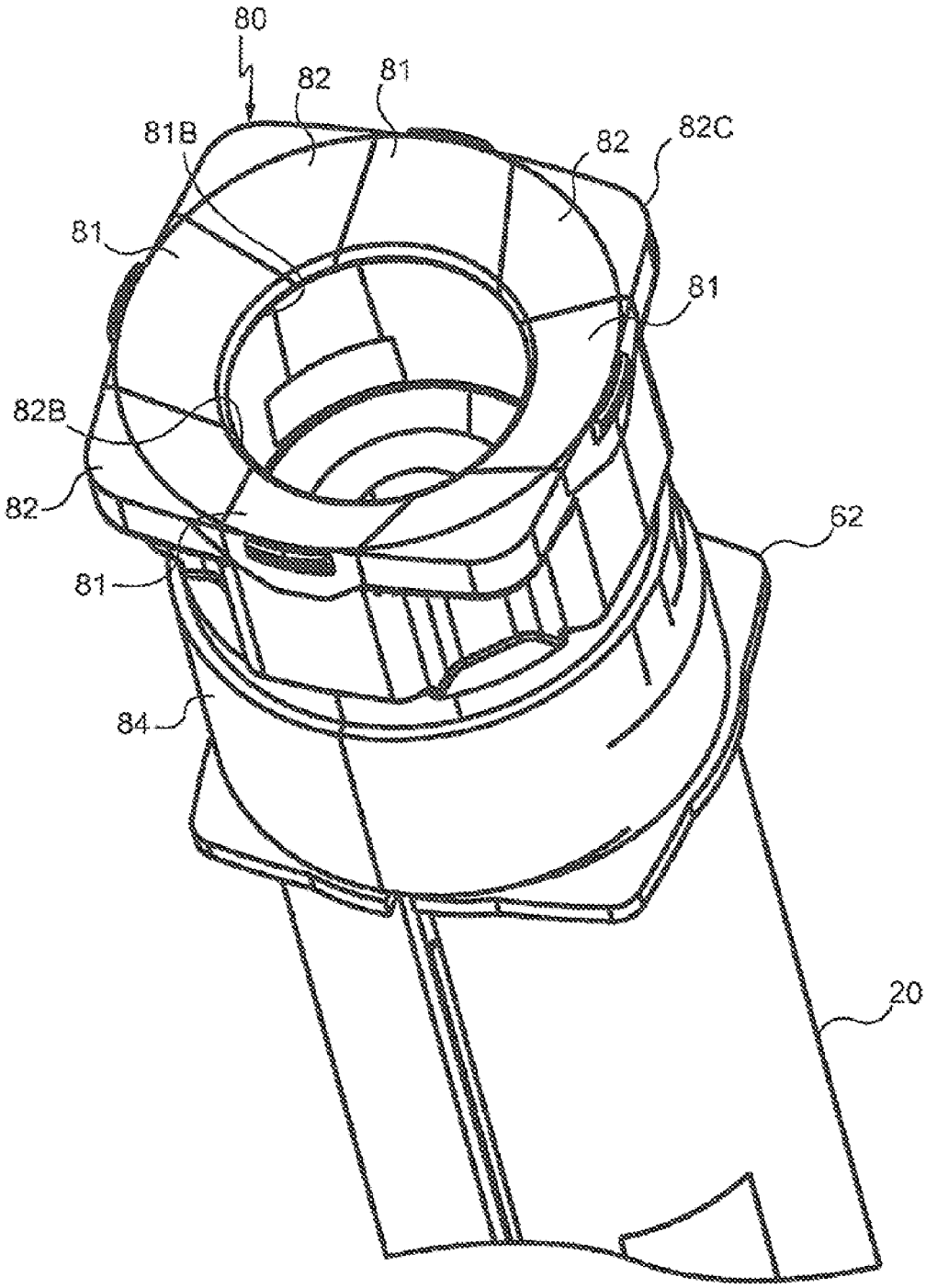
FIG. 7 is a perspective view of the entry portion of the reservoir.
Figure 19:
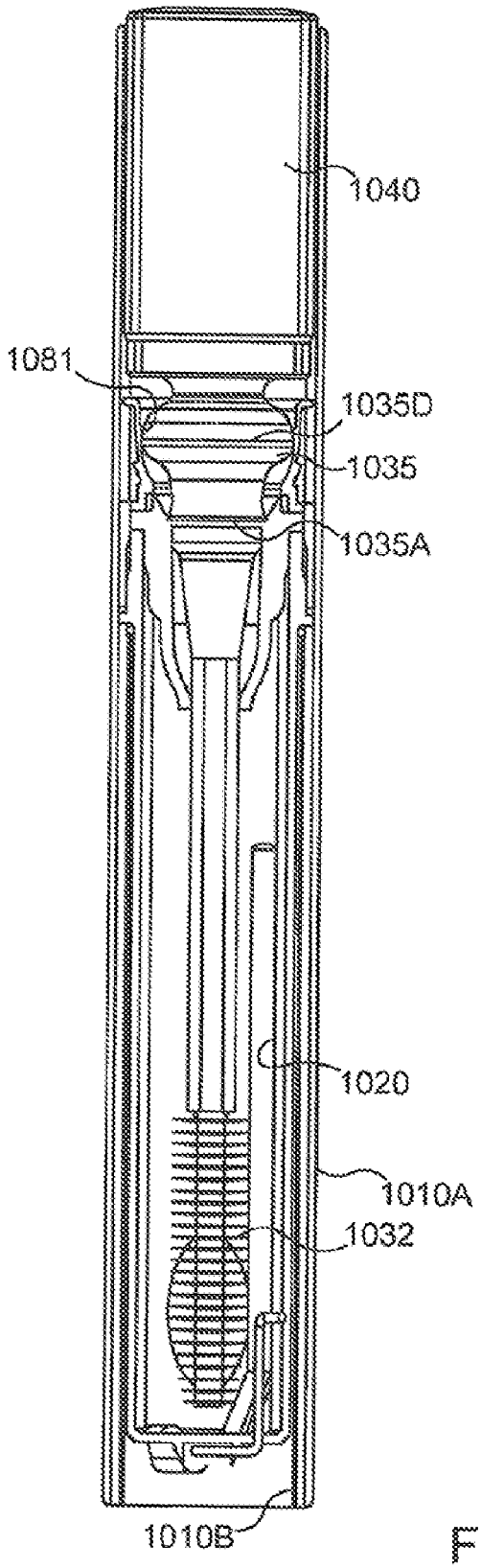
FIG. 19 is a view in elevation of still another embodiment of a container in accordance with the invention, comprising another type of sealing means.

FIG. 19 represents a variant embodiment in which the linking between the reservoir and the application member is obtained by simpler members than those represented in FIG. 7, since it merely a matter of latching.

The members of the container thus represented which are similar to those of FIGS. 8 to 11, in particular, are designated by reference signs which may be deduced from the ones used in the Figures by the addition of the number 1000.

This container differs from the container of FIGS. 1 to 12 mainly by the geometry of the members which are provided on the reservoir to ensure linkage of that reservoir to the application member.

To be precise, the role of the rigid sectors 81 which close like jaws behind the transverse contact surface of the protuberance is here fulfilled by simple bosses 1081 formed on the inside surface of the reservoir, so that they can be passed by the protuberance on entry of the application member into the reservoir; these bosses form obstacles which, to get past, implies that the user must temporarily provide an additional force to that necessary to make the reservoir slide into the body. Of course, by varying the slopes of the zones of these bosses and of the zones of the protuberance which cooperate in the linking configuration between the reservoir and the application member, it is possible to regulate the additional force which must be provided to pass those bosses, in each direction, slight slopes relative to the longitudinal direction in the direction of engagement of the application member in the reservoir only require a slight additional force, whereas the choice of steeper slopes in the other direction, i.e. that of the disengagement, enable strong mutual linking. Other variants are possible to provide the linkage between the reservoir and the application member as well as the sealing function, for example by choosing an appropriate geometry for the seals.

It can be understood that the various aforesaid options may be combined in various ways, and that, in particular, a container in accordance with the invention may combine the construction of FIGS. 1 to 12, by replacing the arm carrying the follower finger by a flexible strip, as is represented in FIG. 13. Furthermore, the elastically compressible device may, as a variant, comprise a set of crowns of the kind described in document EP-1 721 543.

The invention claimed is:

1. A container for a pasty or liquid cosmetic product, comprising:

an elongate body, extending in a longitudinal direction, comprising a bottom zone and a free edge;

a reservoir comprising said product and a neck, wherein the reservoir is movable in translation in the body between a low resting position close to the bottom zone and a high working position close to the free edge;

an elastically compressible guide device, located between the body and the reservoir, wherein:

said guide device comprises a stable retracted configuration defining the low resting position of the reservoir, and a maximum extension configuration defining the high working position of the reservoir, the guide device is convertible between said configurations by retraction of said guide-device beyond the stable retracted position against a spring, and the guide device comprises, on the body or the reservoir, a hollow guide track disposed substantially in the longitudinal direction of the body, and, on the other of the body or the reservoir, a follower finger engaged in the hollow guide track, at least when the guide device is in the maximum extension configuration; and an application member comprising a shaft joined to a cap and terminated by an applicator, wherein:

said application member is adapted to be loaded with said product when the shaft of the application member is inserted through the neck into the reservoir in a reloading configuration, and the cap is adapted, in the reloading configuration, to engage and push the reservoir into the body until the reservoir reaches said low resting position, and, the cap is adapted to be at least partly extracted from the body under the action of the elastically compressible guide device to enable extraction of the application member out of the reservoir and the body;

wherein a mounted-on elastic member is located near the guide track and is adapted to provide a resistant braking point to passage of the follower finger when the elastically compressible guide device leaves the maximum extension configuration and the cap is pushed into the body.

2. The container of claim 1, wherein the application member and the reservoir comprise complementary linking members adapted to link the application member with the reservoir during travel of the reservoir from the low resting position to the high working position, and to enable an extraction force applied to the cap of the application member to move the reservoir towards the high working position.

3. The container of claim 2, wherein the complementary linking members are adapted to seal a location between the shaft of the application member and the reservoir.

4. The container of claim 2, wherein:

the shaft of the application member comprises a protuberance comprising a sealing portion located toward the applicator, and a transverse contact surface located towards the cap;

the reservoir comprises a seal-forming constriction adapted to receive the sealing portion in axial abutment and a collar formed, along a circumference of the collar, by a plurality of rigid sectors and elastic sectors;

the collar comprises a relaxed configuration wherein it is larger than the inside cross-section of the body, and a restricted configuration wherein it is confined inside the body; and the rigid sectors comprise rims along the inside edge of the collar, wherein the rims are adapted to axially abut against the transverse contact surface of the protuberance to maintain the sealing portion against the seal-forming constriction when the reservoir is in the low resting configuration.

5. The container of claim 2, wherein the shaft of the application member comprises:

a protuberance comprising, towards the applicator, a sealing portion, and, towards the cap, a transverse contact surface, and bosses in a cavity of the reservoir that are adapted to pass over the protuberance when the application member is moved into the reloading configuration in the reservoir, and to maintain the protuberance against a seat-forming constriction when the application member is in the reloading configuration.

6. The container of claim 1, wherein the follower finger remains engaged in the hollow guide track when the elastically compressible guide device passes from one of its configurations to the other, wherein the hollow guide track comprises a heart-shaped portion comprising a W-shaped zone wherein the central portion of the W-shaped zone defines the stable retracted configuration, and further wherein the following finger can only move past the central portion of the W-shaped zone in a single direction.

7. The container of claim 6, wherein that heart-shaped portion is spaced away from a zone of the hollow guide track where the follower finger is engaged when the elastically compressible guide device is in the maximum extension configuration.

8. The container of claim 6, wherein a part of the guide track, the elastic member, and the follower finger define the high working position of the reservoir, further wherein said part of the guide track comprises a drop-shaped portion comprising a point oriented towards a point of the heart shaped portion.

9. The container of claim 8, wherein the hollow guide track comprises, between the heart-shaped portion and drop-shaped portion, a single longitudinal portion adapted to be passed along by the follower finger in both directions.

10. The container of claim 1, wherein the mounted-on elastic member comprises an elastic member capable of deforming parallel to the walls of the reservoir and of the body and transversely to the longitudinal direction of the body.

11. The container of claim 10, wherein the mounted-on elastic member comprises a mounted-on elastic strip disposed close to a lateral flank of the hollow guide track, such that the passage of the follower finger causes deformation of the mounted-on elastic strip.

12. The container of claim 10, wherein:

the guide track comprises a portion adapted to be passed along in both axial directions by said follower finger, the mounted-on elastic member comprises a U-shaped part comprising branches that are longitudinally oriented and form a space between them adapted to receive the follower finger, and the mounted-on elastic member comprises a constriction formed by the ends of the branches and is adapted such that the follower finger can only pass the constriction by spreading apart the branches of the U-shaped part.

13. The container of claim 12, wherein:

the U-shaped part is engaged in a cavity that is set back relative to a bottom of the guide track, the guide track comprises a connecting ramp adapted such that the follower finger slides over the branches of the U-shaped part and latches in said space when the reservoir approaches the high working position, and the connecting ramp is adapted such that when the reservoir is moved towards the low resting position, the follower finger passes the constriction by spreading apart the branches to reach the bottom of the guide track.

14. The container of claim 1, wherein:

the guide track comprises a portion adapted to be passed in both axial directions by the follower finger, and the mounted-on elastic member comprises an elastic strip comprising the follower finger, wherein said elastic strip presses the follower finger towards the bottom of the hollow guide track.

15. The container of claim 1, wherein the hollow guide track is joined to the body and the follower finger is joined to the reservoir.

16. The container of claim 1, wherein the spring, the hollow guide track, and the follower finger are located between the lateral walls of the body and of the reservoir.

* * * * *